United States Patent [19]

Kanzaka

[11] Patent Number: 4,570,307

[45] Date of Patent: Feb. 18, 1986

[54] BUTTON HAVING PLATE FOR DEFLECTING AN ATTACHING TACK

[75] Inventor: Yoshihiro Kanzaka, Toyama, Japan

[73] Assignee: Nippon Notion Kogyo Co., Ltd., Tokyo, Japan

[21] Appl. No.: 601,789

[22] Filed: Apr. 19, 1984

[30] Foreign Application Priority Data

Apr. 26, 1983 [JP] Japan ..... 58-62541[U]

[51] Int. Cl.[4] ..... A44B 1/42

[52] U.S. Cl. ..... 24/95; 24/90 R; 24/90 C; 24/94; 24/689

[58] Field of Search ..... 24/90 R, 90 C, 95, 96, 24/94, 113 R, 113 MP, 671, 674, 687, 689

[56] References Cited

U.S. PATENT DOCUMENTS

| | | | |
|---|---|---|---|
| 1,191,944 | 7/1916 | Carley | 24/95 |
| 1,387,115 | 8/1921 | Anderson | 24/90 C |
| 1,707,592 | 4/1929 | Abel | 24/95 |
| 1,718,843 | 6/1929 | White et al. | 24/94 |
| 1,885,816 | 11/1932 | Ford | 24/689 |
| 2,170,092 | 8/1939 | Peterson et al. | 24/95 |
| 3,320,644 | 5/1967 | Daddona, Jr. | 24/95 |
| 4,197,617 | 4/1980 | Appelt | 24/95 |
| 4,280,255 | 7/1981 | Ishizaki | 24/95 |

FOREIGN PATENT DOCUMENTS

| | | | |
|---|---|---|---|
| 161282 | 6/1904 | Fed. Rep. of Germany | 24/94 |

*Primary Examiner*—Victor N. Sakran

*Attorney, Agent, or Firm*—Hill, Van Santen, Steadman & Simpson

[57] ABSTRACT

A button for being attached to a garment fabric has a button body composed of a double-walled tubular stem with an annular flange extending radially outwardly therefrom, a cap having an internal back place mounted on the annular flange, and a tack member having a central shank for penetrating the garment fabric and for extending into the tubular stem to join the tack member to the button body with the garment fabric interposed therebetween. The annular flange includes a first marginal wall flaring radially outwardly and having a plurality of radially outward projections. The cap also has a second marginal wall fitted over the first marginal wall and including a plurality of protuberances deformed radially outwardly by the projections, respectively. The projections and the protuberances are held in interlocking engagement for preventing the button body and the cap from rotating relatively to each other. The shank of the tack member has a tapered end portion which, upon being forced into the button body, is elastically deformable against the back plate laterally into the form of a retainer hook held in locking engagement with the tubular stem.

6 Claims, 10 Drawing Figures

BUTTON HAVING PLATE FOR DEFLECTING AN ATTACHING TACK

BACKGROUND OF THE INVENTION

1. Field of the Invention

The present invention relates to a button for secure attachment to a garment fabric, and more particularly to a button having a capped button body composed of a double-walled tubular stem with an integral annular flange and a cap affixed to the annular head, and a tack member including a shank insertable in and fastenable by staking to the tubular stem for attaching the button to a garment fabric.

2. Prior Art

Buttons for being attached to garments by staking, not by threads, generally have a botton body composed of a tubular stem with an integral annular flange, a cap fitted firmly over a peripheral edge of the flange, and a tack member adapted to be inserted in and fastened by staking to the tubular stem. The annular flange extends radially outwardly from an upper end of the tubular stem, and includes a flaring marginal portion providing the peripheral edge of the flange, thus giving the flange a generally dish-shaped configuration. The peripheral edge of the flange has a smooth outer circumferential surface. Therefore, the cap as it is fitted over the peripheral edge of the flange even by staking tends to become loosened upon application of undue forces or under rough use. The cap then can rotate relatively to the button body at the time the tack member is fastened to the button body or after the button has been attached to a garment fabric. Such loose caps are particularly disadvantageous in that any directional markings or ornamental patterns printed, engraved, or otherwise set down on a set of caps will be easily disoriented in a random fashion after the caps have been attached to a garment, resulting in an unsightly appearance.

SUMMARY OF THE INVENTION

It is accordingly an object of the present invention to provide a button for attachment to garments which has a cap and a button body that are securely fastened together against relative rotation.

Another object of the present invention is to provide a button for being attached to garments which includes a button body flange of a stiffened construction on which a cap is fixedly mounted.

According to the present invention, a button includes a button body having a double-walled tubular stem with an integral flange extending radially outwardly therefrom and having a marginal wall flaring radially outwardly and having a plurality of radially outwardly directed projections, a cap having a marginal wall fitted by staking over the marginal wall of the body, a back plate disposed between the flange and the cap, and a tack member having a shank extending through the tubular stem and a tapered end portion deformed against the back plate into locking engagement with the tubular stem. The projections of the marginal wall of the flange are held in interengagement with protuberances of the marginal wall of the cap, which are formed when the marginal wall of the cap is pressed against the marginal wall of the flange. The interlocking engagement of the projections and protuberances prevents the cap from rotating with respect to the button body and reinforces the marginal walls against deformation.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 8:
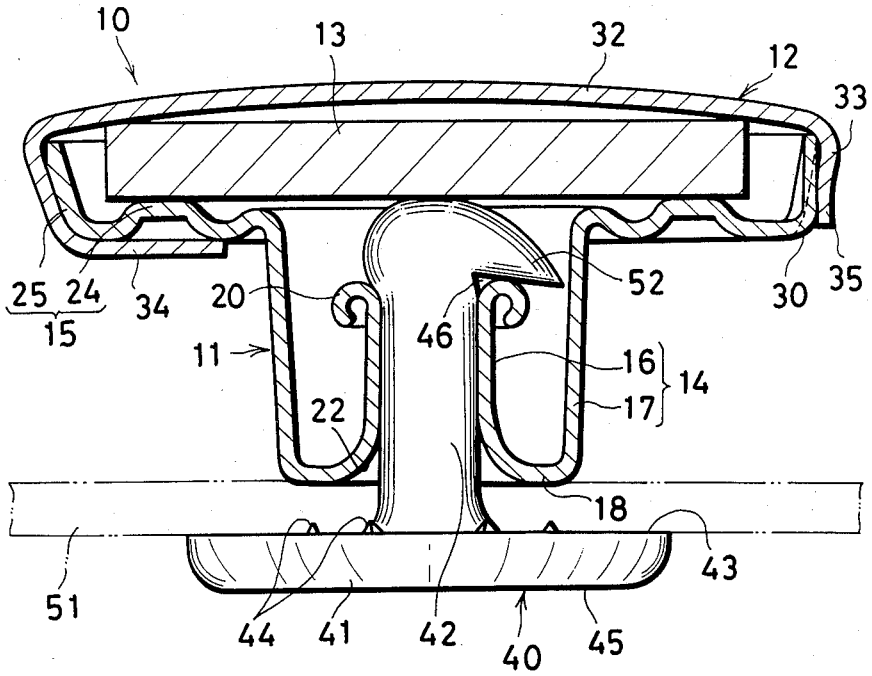
FIG. 8 is an axial cross-sectional view of the button body and cap assembly with the tack member inserted and staked therein for attachment to a garment fabric.

The principles of the present invention are particularly useful when embodied in a button as shown in FIG. 8.

The botton comprises a button body and cap assembly, generally indicated by the reference numeral 10, which is mainly composed of a button body 11, a cap 12 mounted thereon, and a back plate 13 placed between the button body 11 and the cap 12. The button body 11 and the cap 12 are preferably made of brass, and the back plate 13, of iron or steel.

The button body 11 includes a hollow, double-walled tubular stem 14 having an integral annular flange 15 extending radially outwardly from an upper end of the tubular stem 14. The double-walled tubular stem 14 comprises an inner tube 16 and an outer tube 17 spaced radially outwardly from the inner tube 16 and joined thereto by an annular bottom 18. The inner tube 16 includes an upper annular rib 20 arcuately curled radially outwardly and downwardly and terminating in a downwardly directed edge 21. The annular rib 20 has an outside diameter D larger than the diameter of the downwardly directed edge 21. The inner tube 16 also has a radially outwardly flaring corner wall 22 blending into the annular bottom 18, which is joined to the outer tube 17 by a relatively sharp corner wall 23.

Figure 1:
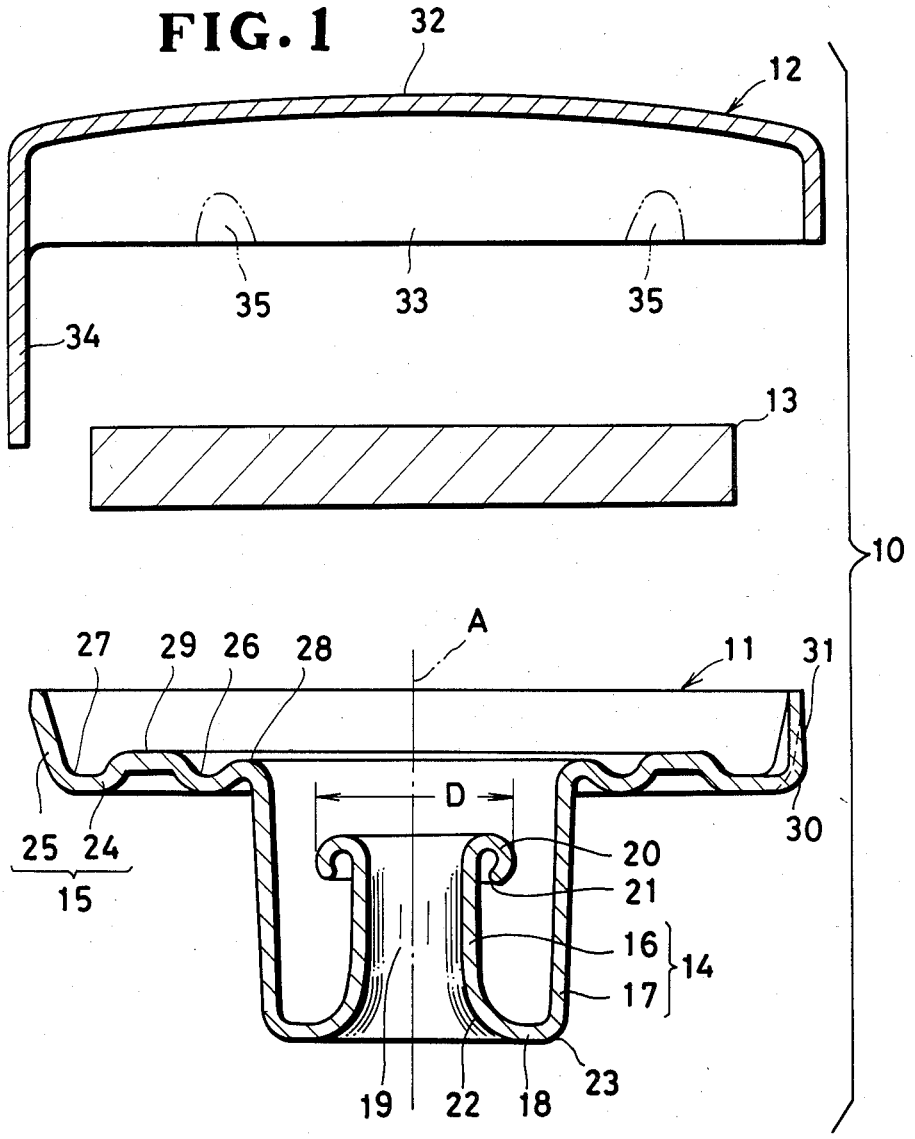
FIG. 1 is an exploded axial cross-sectional view of a button body and cap assembly of a button according to the present invention.
Figure 2:
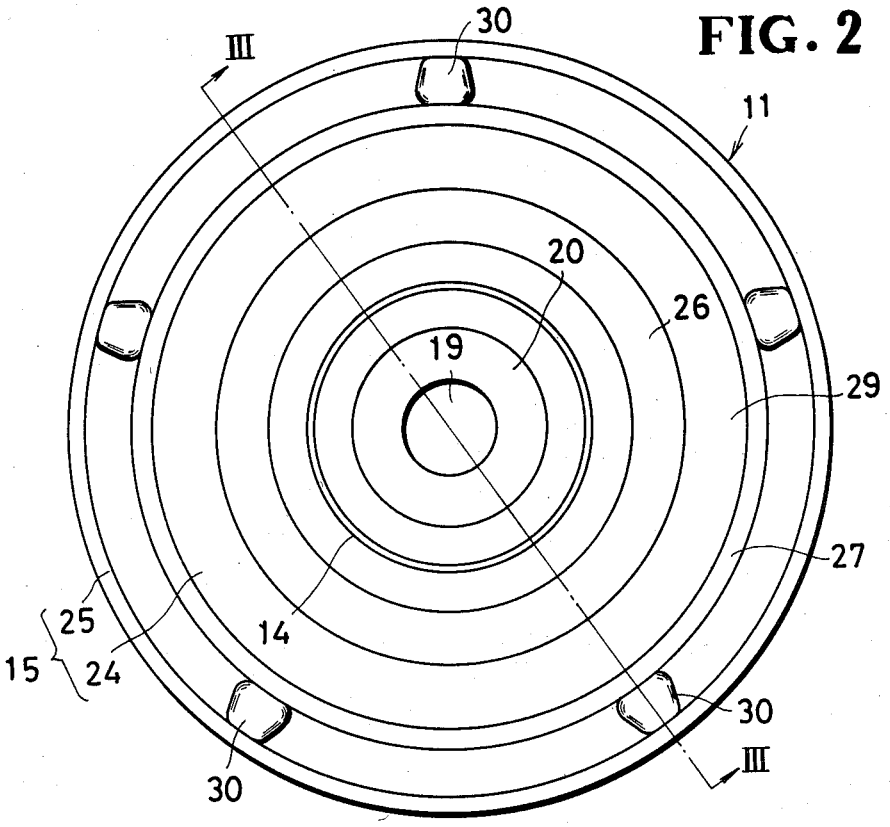
FIG. 2 is plan view of the button body of the assembly shown in FIG. 1.

The annular flange 15 is composed of a flange bottom 24 extending radially outwardly from an upper end of the outer tube 17 and a marginal wall 25 flaring radially outwardly and integrally extending from an outer peripheral edge of the flange bottom 24. In the illustrated wembodiment, the outwardly flaring marginal wall 25 extends at an angle of about 75 degrees with respect to the flange bottom 24. The flange bottom 24 includes a pair of inner and outer annular grooves 26, 27 radially spaced from each other in concentric relation. The annular groove 26 and the upper end of the outer tube 17 define an annular ridge 28 therebetween, and the annular grooves 26, 27 define an annular land 29 therebetween. As illustrated in FIGS. 1 and 2, the marginal wall 25 of the flange 15 has a plurality, five in FIG. 2, of radially outward projections 30 angularly spaced at equal intervals. The projections 30 are preferably formed by punching the marginal wall 25 radially outwardly across all its width between upper and lowr edges thereof. Each of the projections 30 has an outer surface 31 extending substantially parallel to a central axis A (FIG. 1) of the button body 11.

As shown in FIG. 1, the cap 12 includes a slightly domed or upwardly rounded circular top 32 and an outer annular marginal wall 33 extending downwardly from an outer peripheral edge of the circular top 32. The circular top 32 is rounded at a radius of curvature slightly larger than the diameter thereof. The cap 12 also has a tongue 34 extending downwardly from the annular marginal wall 33. The tongue 34 serves as a positioning reference used when the button is angularly positioned with respect to a garment fabric to which the button is to be attached.

Figure 3:
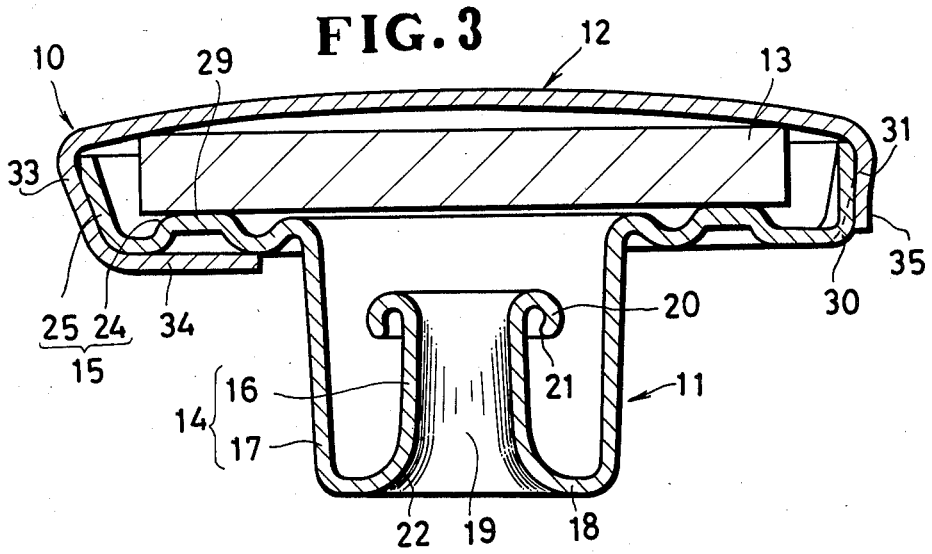
FIG. 3 is an axial cross-sectional view taken along line III—III of FIG. 2, showing an assembled button body and cap assembly.
Figure 4:
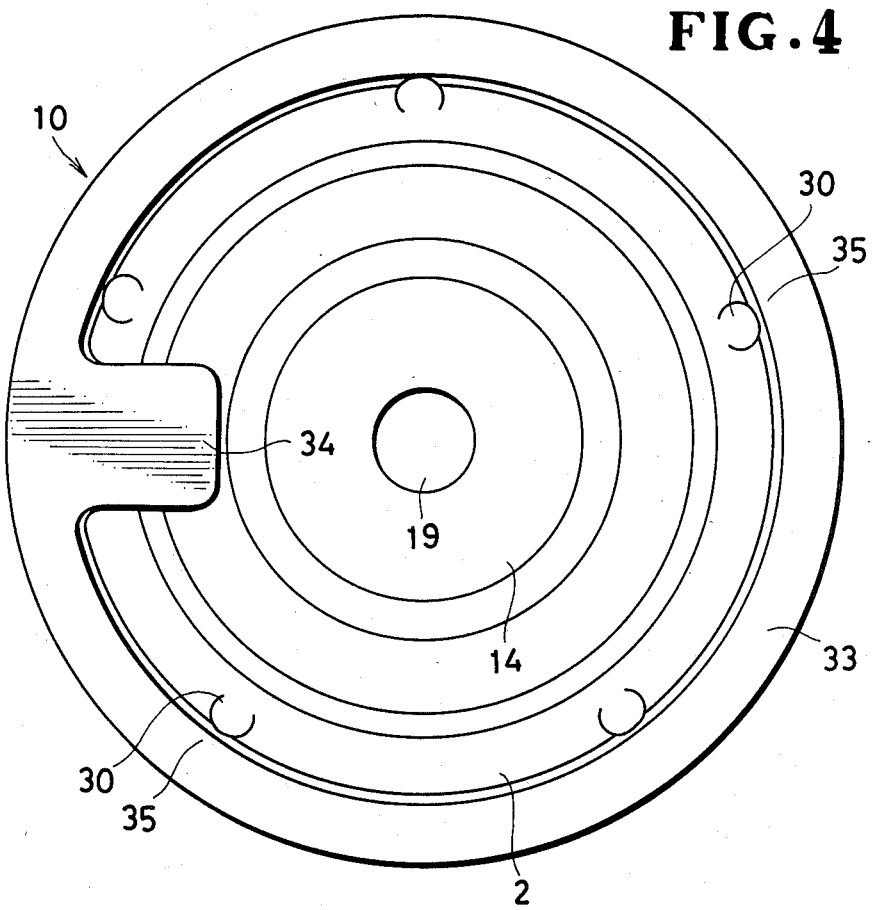
FIG. 4 is a bottom view of the assembly of FIG. 3.

The button body 11, the cap 12, and the back plate 13 are assembled together as follows: While the button body 11 is held with the flange 15 facing upwardly, the back plate 13 is placed on the flange bottom 24 in contact with the annular land 29, as shown in FIG. 3. Then, the cap 12 is disposed over the flange 15 such that the marginal wall 33 of the cap 12 is fitted around the marginal wall 25 of the flange 15. The marginal wall 33 of the cap 12 is thereafter staked on the marginal wall 25 of the flange 15 as by deforming the marginal wall 33 against the marginal wall 25 with a press or other suitable means. At this time, the positioning tongue 34 is also pressed against a lower surface of the flange bottom 24 as shown in FIG. 4.

With the cap 12 thus assembled on the button body 11, the projections 30 on the marginal wall 25 of the flange 15 are slightly depressed by the pressed marginal wall 33 of the cap 12, and the marginal wall 33 is also slightly deformed into radially outward protuberances 35 by the projections 30 which bite into the marginal wall 33. Since the projections 30 and the protuberances 35 are firmly interlocked with each other, the cap 12 is prevented from being rotated with respect to the button body 11 during use of the button. Furthermore, the interengaging projections 30 and the protuberances 35 serve as stiffeners for reinforcing the marginal walls 30, 33 against forces tending to deform these marginal walls 30, 33.

Figure 5:
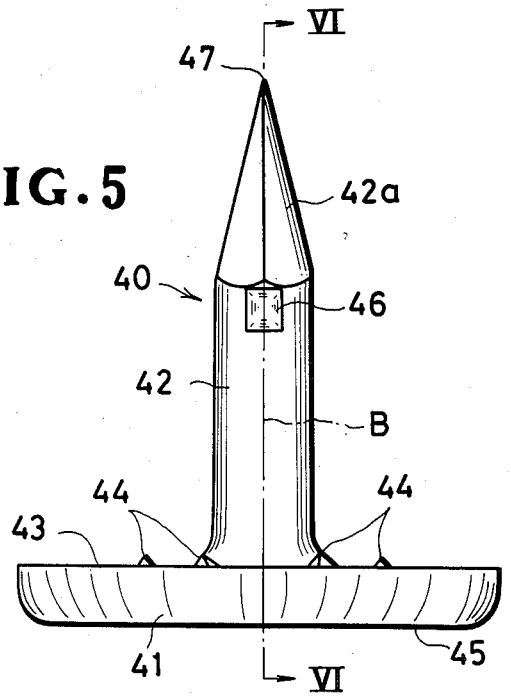
FIG. 5 is a front elevational view of a tack member to be combined with the assembly of FIG. 3.
Figure 6:
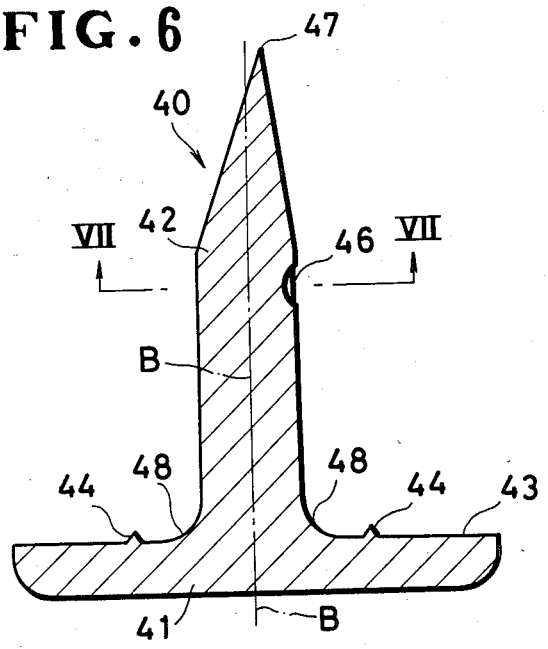
FIG. 6 is a cross-sectional view taken along line VI—VI of FIG. 5.
Figure 7:
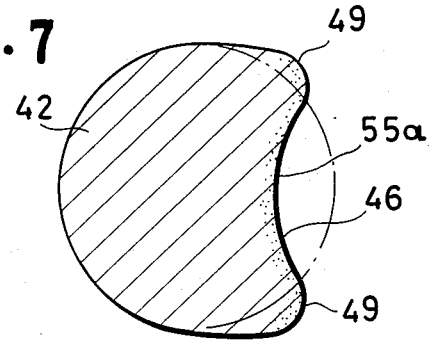
FIG. 7 is an enlarged cross-sectional view taken along line VII—VII of FIG. 6.

As shown in FIGS. 5 through 7, a tack member 40 for attaching the button body and cap assembly 10 to an object such as a garment fabric is composed of a circular head 41 and a shank 42 of a circular cross section projecting coaxially from the center of the circular head 41. The circular head 41 has a flat surface 43 from which the shank 42 projects, the flat surface 43 having a plurality of small biting teeth 44, and an opposite flat surface 45 facing remotely from the shank 42. The shank 42 has a recess 46 defined in a circumferential surface thereof and axially spaced from the head 41. The shank 42 also includes a tapered end portion 42*a* of a pyramidal configuration located immediately above the recess 46 and terminating in a pointed end 47. As shown in FIG. 6, the pointed end 47 is transversely displaced off a central axis B of the shank 42 toward the recess 46. The shank 42 has an arcuately curved end surface 48 blending into the flat surface 43 of the head 41.

The recess 46 is positioned on the shank 42 such that the recess 46 will be held substantially in alignment with the annular rib 20 as the tack member 40 is inserted in the button body 11 as shown in FIG. 8. The recess 46 is defined by punching the circumferential surface of the shank 42 with a punch (not shown) of a substantially prismoidal shape having rounded corners at its punching end. Therefore, the recess 46 has a configuration complementary to that of the punch. As illustrated in FIG. 7, after the recess 46 has been formed in the shank 42, a mass of material of the shank 42 is displaced due to plastic deformation into lateral raised portions 49, 49 on opposite sides of the recess 46. By being punched, the bottom of the recess 46 and the raised portions 49, 49 have a surface layer 55 harder than the other portion of the shank 42.

For attaching the button body and cap assembly 10 to a garment fabric 51 (FIG. 8 ) with the tack member 40, the shank 42 is forced to penetrate the garment fabric 51 and is inserted into the inner tube 16 of the button body 11. At this time, the flaring corner wall 22 allows the shank 42 to be easily inserted into the inner tube 16. Then, the button body and cap assembly 10 and the tack member 40 are forcibly pressed axially together by a punch (not shown) to deform the tapered end portion 42*a* against the back plate 13 into a plastically deformed retainer hook 52 bent substantially through an angle of 90 degrees around the recess 46 in locking engagement with the annular rib 20 of the inner tube 16. The tapered end portion 42*a* can relatively easily be deformed into the retainer hook 52 in response to an applied axial pressing force because the pointed end 47 of the tapered end portion 42*a* as undeformed is laterally displaced off the central axis B of the shank 42 and the recess 46 is positioned directly below the tapered end portion 42*a*. Therefore, the tapered end portion 42*a* can easily yield laterally under the pressing force applied axially to the tapered end portion 42*a*. When the shank 42 of the tank member 40 is axially forced against the back plate 13, the latter imposes a force against the cap 12 in a direction tending to separate the cap 12 from the flange 15 of the button body 11. However, the cap 12 and the flange 15 remain firmly joined to each other since the marginal walls 30, 33 are securely united and reinforced by the projections 30 and protuberances 35. The retainer hook 52 held in locking engagement with the annular rib 20 protects the tack member 40 against accidental removal of the latter from the botton body 11, and also serves to prevent relative rotation of the tack member 40 and the button body and cap assembly 10. When the tack member 40 and the button body 11 are thus assembled together, the teeth 44 on the head 41 of the tack member 40 bite into the garment fabric 51 so that the tack member 40 and hence the assembled button are prevented from rotating on the garment fabric 51.

Figure 9:
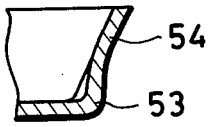
FIGS. 9 and 10 appearing with FIG. 4, are fragmentary cross-sectional views showing modified caps.

FIG. 9 shows a modified flange construction having a plurality of radially outward projections 53 (one shown) on a radially outwardly flaring marginal wall 54. Each projection 53 is provided by radially outwardly punching the marginal wall 54 only at a lower portion thereof. Thus, the marginal wall 54 has an outermost peripheral edge located radially outwardly of the outer surfaces of the projections 53.

Figure 10:
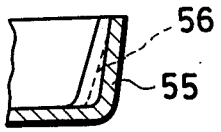

According to another modification shown in FIG. 10, each of a plurality of projections 55 (one shown) is bodily displaced radially outwardly beyond the outer peripheral surface of a radially outwardly flaring marginal wall 56. Each projection 55 is formed by punching the marginal wall 56 radially outwardly across all the width thereof between its upper and lower edges. The projections 55 as they engage the marginal wall of the cap leave gaps between the cap and the marginal wall 56 for draining any water trapped in the button as when the garment with the button attached is laundered.

Although various minor modifications may be suggested by those versed in the art, it should be understood that I wish to embody within the scope of the patent warranted hereon, all such embodiments as reasonably and properly come within the scope of my contribution to the art.

What I claim is:

1. A button for attachment to a garment fabric, comprising:

(a) a button body including a tubular stem and an annular flange extending radially outwardly from an end of said tubular stem, said annular flange including a flange bottom and a first marginal wall flaring radially outwardly from said flange bottom and having a plurality of radially outwardly extending projections;

(b) a cap mounted on said button body and having a second marginal wall deformed over said first marginal wall and including a plurality of protuberances extending radially outwardly due to deformation of said second wall by said projections, respectively, and held in interlocking engagement therewith against relative rotation;

(c) a back plate disposed between said button body and said cap and having a portion placed on said flange bottom; and (d) a tack member having a circular head and a shank extending centrally from said circular head and including a tapered end portion for being pierced through the garment fabric and inserted into said tubular stem, said tapered end portion being plastically bendable against said back plate laterally into a hook held in locking engagement with said tubular stem when said tapered end portion is forced into said button body.

2. A button according to claim 1, each of said projections having a radially outward surface extending substantially parallel to a central axis of said button body.

3. A button according to claim 1, each of said projections extending across all the width of said first marginal wall.

4. A button according to claim 1, each of said projections being a deformed portion of said first marginal wall.

5. A button according to claim 1, said first marginal wall having an outermost peripheral edge located radially outwardly of outer surfaces of said projections.

6. A button according to claim 1, each of said projections being bodily displaced radially outwardly beyond an outer peripheral surface of said first marginal wall.

* * * * *